US009960496B2

(12) United States Patent
Kim

(10) Patent No.: US 9,960,496 B2
(45) Date of Patent: May 1, 2018

(54) ANTENNA AND VEHICLE INCLUDING THE SAME

(71) Applicant: HYUNDAI MOTOR COMPANY, Seoul (KR)

(72) Inventor: Dongjin Kim, Seoul (KR)

(73) Assignee: Hyundai Motor Company, Seoul (KR)

( * ) Notice: Subject to any disclaimer, the term of this patent is extended or adjusted under 35 U.S.C. 154(b) by 30 days.

(21) Appl. No.: 14/958,455

(22) Filed: Dec. 3, 2015

(65) Prior Publication Data

US 2017/0062942 A1 Mar. 2, 2017

(30) Foreign Application Priority Data

Sep. 1, 2015 (KR) ..... 10-2015-0123555

(51) Int. Cl.

| | |
|---|---|
| ***H01Q 13/06*** | (2006.01) |
| ***H01Q 21/00*** | (2006.01) |
| ***H01Q 21/06*** | (2006.01) |
| ***H01Q 13/22*** | (2006.01) |
| ***H01Q 1/32*** | (2006.01) |

(52) U.S. Cl.

CPC ..... *H01Q 13/06* (2013.01); *H01Q 1/32* (2013.01); *H01Q 1/3275* (2013.01); *H01Q 13/22* (2013.01); *H01Q 21/0006* (2013.01); *H01Q 21/06* (2013.01); *H01Q 21/064* (2013.01)

(58) Field of Classification Search

CPC ..... H01Q 1/32; H01Q 1/50; H01Q 13/06; H01Q 13/10; H01Q 13/22; H01Q 21/0006; H01Q 21/06; H01Q 1/3275; H01Q 21/064

See application file for complete search history.

(56) References Cited

U.S. PATENT DOCUMENTS 3,474,454 A * 10/1969 Kempic ..... H01Q 3/38 333/109
5,973,647 A * 10/1999 Barrett ..... H01Q 21/068 333/137

(Continued)

FOREIGN PATENT DOCUMENTS

JP 2007-274236 A 10/2007
JP 2007-295242 A 11/2007

(Continued)

OTHER PUBLICATIONS

Korean Office Action issued in Application No. 10-2015-0123555 dated Jul. 21, 2016.

*Primary Examiner* — Hoang Nguyen
(74) *Attorney, Agent, or Firm* — McDermott Will & Emery LLP

(57) ABSTRACT

An antenna having a low loss rate, high radiation directivity, and wideband characteristics in a millimeters wavelength region to be suitable for 5th-Generation (5G) communication, and having a low-profile structure to reduce air resistance when installed in a vehicle includes a feed circuit through which a radio signal provided from a feed point is transmitted; and a plurality of radiation units, each radiation unit including a diverging wall configured to cause the radio signal transmitted through the feed circuit to diverge in at least two directions, and at least two diverging cavities through which radio signals diverged by the diverging wall are transmitted. A vehicle including the antenna is described.

24 Claims, 21 Drawing Sheets

(56) References Cited

U.S. PATENT DOCUMENTS

| | | | | |
|---|---|---|---|---|
| 2013/0229210 | A1 | 9/2013 | Siles et al. | |
| 2014/0198005 | A1* | 7/2014 | Hnatiw | H01Q 13/085 343/776 |
| 2016/0036131 | A1* | 2/2016 | Kim | H01Q 13/18 343/771 |

FOREIGN PATENT DOCUMENTS

| | | | |
|---|---|---|---|
| JP | 2014-170989 | A | 9/2014 |
| KR | 10-0808811 | B1 | 3/2008 |
| KR | 10-1270882 | B1 | 6/2013 |

* cited by examiner

ANTENNA AND VEHICLE INCLUDING THE SAME

CROSS-REFERENCE TO RELATED APPLICATION

This application claims the benefit of priority to Korean Patent Application No. 10-2015-0123555, filed on Sep. 1, 2015 in the Korean Intellectual Property Office, the disclosure of which is incorporated herein by reference.

BACKGROUND

1. Field

Embodiments of the present disclosure relate to an antenna that can be applied to 5th-Generation (5G) communication, and a vehicle including the antenna.

2. Description of the Related Art

Recently, many vehicles can function as an agent of communication, in addition to a driving function, to communicate with an external server, an external communication terminal, or another vehicle to transmit/receive data to/from the external server, the external communication terminal, or the other vehicle.

In order to perform communication, a vehicle needs an antenna to receive radio signals from free space and to radiate radio signals to the free space.

The antenna should be able to minimize loss in a communication frequency band, and have a low-profile structure in consideration of air resistance so that the antenna can be installed in a vehicle.

SUMMARY

Therefore, it is an aspect of the present disclosure to provide an antenna having a low loss rate, high radiation directivity, and wideband characteristics in a millimeters wavelength region to be suitable for 5th-Generation (5G) communication, and having a low-profile structure to reduce air resistance when installed in a vehicle, and to provide a vehicle including the antenna.

Additional aspects of the disclosure will be set forth in part in the description which follows and, in part, will be obvious from the description, or may be learned by practice of the disclosure.

In accordance with one aspect of the present disclosure, an antenna installed in a vehicle includes: a feed circuit through which a radio signal provided from a feed point is transmitted; and a plurality of radiation units, each radiation unit including a diverging wall configured to cause the radio signal transmitted through the feed circuit to diverge in at least two directions, and at least two diverging cavities through which radio signals diverged by the diverging wall are transmitted.

The feed circuit may be disposed parallel to the ground on which the vehicle is placed, and the diverging cavities may be connected to a top end of the feed circuit.

The at least two diverging cavities may have the same shape and be of the same size.

The diverging wall may match the impedance of the radio signal.

The diverging wall may be formed with at least one metal selected from among metals including copper, aluminum, lead, silver, and stainless steel.

The radiation unit may further include at least two radiation cavities which are respectively disposed on the at least two diverging cavities, and in which at least two radiation slots for radiating the radiation signals to the outside are formed.

The radiation cavities may change a transmission direction of the radio signals.

The radiation unit may further include a harmonics blocking filter configured to remove a harmonic component of the radio signal.

The harmonics blocking filter may include at least two harmonics blocking filters disposed between the at least one two diverging cavities and the at least two radiation cavities.

The harmonics blocking filter may have a size that is determined based on the size of each diverging cavity and the energy of the radio signal.

The radiation cavities may be curved at bent parts to change the transmission direction of the radio signals.

In the radiation cavities, an antireflection wall protruding toward the inside of the radiation cavities, may be configured to block reflection of the radio signals in the radiation slots.

The location and thickness of the antireflection wall may be determined according to the frequency of the radio signal.

The radiation slots may open in a direction in which the radio signal is transmitted in the feed circuit.

The radio signal may be transmitted upward toward the diverging cavities from one end of the feed circuit, transmitted upward toward the radiation cavities from the diverging cavities, and then change a transmission direction in the radiation cavities so as to be transmitted toward the radiation slots.

The feed circuit may diverge into a plurality of branches from at a feed point.

In the feed circuit, distances from the feed point to the plurality of radiation units may be the same.

In accordance with another aspect of the present disclosure, there is provided a vehicle in which an antenna is installed, the antenna including: a feed circuit through which a radio signal provided from a feed point is transmitted; and a plurality of radiation units, each radiation unit including a diverging wall configured to cause the radio signal transmitted through the feed circuit to diverge in at least two directions, and at least two diverging cavities through which radio signals diverged by the diverging wall are transmitted.

The feed circuit may be disposed parallel to the ground on which the vehicle is placed, and the diverging cavities may be connected to a top end of the feed circuit.

The radiation unit may further include at least two radiation cavities which are respectively disposed on the at least two diverging cavities, and in which at least two radiation slots for radiating the radiation signals outside are formed.

The radiation cavities may change a transmission direction of the radio signals.

The radiation unit may further include a harmonics blocking filter configured to remove a harmonic component of the radio signal.

The harmonics blocking filter may have a size that is determined based on size of each diverging cavity and energy of the radio signal.

In the radiation cavities, an antireflection wall protruding toward the inside of the radiation cavities may be configured to block reflection of the radio signals in the radiation slots.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
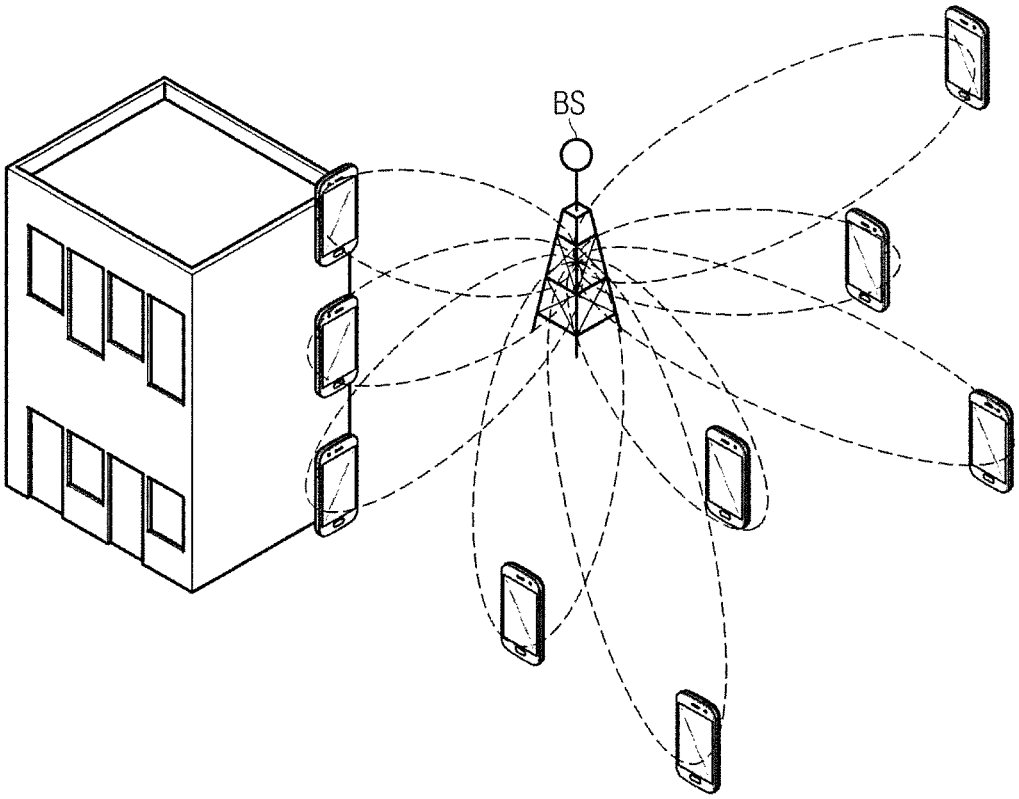
FIG. 1 shows a large-scale antenna system of a base station according to a 5th-Generation (5G) communication method.

Reference will now be made in detail to the embodiments of the present disclosure, examples of which are illustrated in the accompanying drawings, wherein like reference numerals refer to like elements throughout.

An antenna according to an embodiment in the present disclosure may be installed in a vehicle to transmit/receive radio signals so that the vehicle can communicate with an external terminal, an external server, or another vehicle.

The radio signals that are transmitted/received by the antenna according to an embodiment in the present disclosure may be signals based on 2nd-Generation (2G) communication (for example, Time Division Multiple Access (TDMA) and Code Division Multiple Access (CDMA)), 3rd-Generation (3G) communication (for example, Wide Code Division Multiple Access (WCDMA), Code Division Multiple Access 2000 (CDMA2000), Wireless Broadband (Wibro), and World Interoperability for Microwave Access (WiMAX)), 4th-Generation (4G) communication (for example, Long Term Evolution (LTE) and Wireless Broadband Evolution), or 5th-Generation (5G) communication.

In the embodiment which will be described below, it is assumed that the antenna transmits/receives radio signals based on 5G communication.

Figure 2:
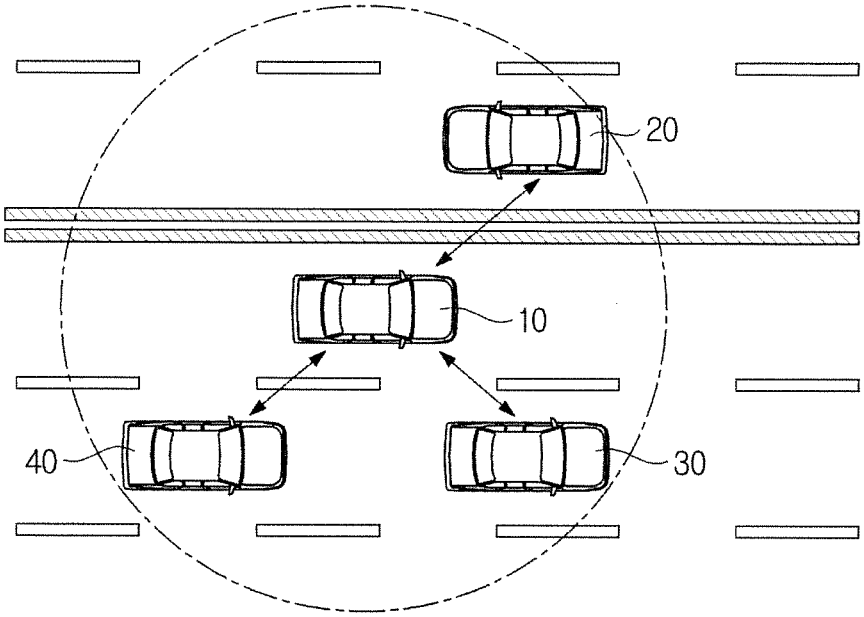
FIG. 2 is a view for describing a network based on a 5G communication method according to an embodiment in the present disclosure.

FIG. 1 shows a large-scale antenna system of a base station according to 5G communication, and FIG. 2 is a view for describing a network based on 5G communication according to an embodiment in the present disclosure.

In 5G communication, a large-scale antenna system can be adopted. A large-scale antenna system is a system that uses several tens of antennas or more to cover an ultra-high frequency band, and that can transmit/receive a large amount of data at the same time through multiple access. More specifically, the large-scale antenna system adjusts arrangement of antenna elements to transmit radio waves farther in a specific direction, thereby enabling massive transmission while expanding an available area of a 5G communication network.

Referring to FIG. 1, a base station BS may transmit/receive data to/from many devices simultaneously through a large-scale antenna system. The large-scale antenna system may minimize transmission of radio waves in different directions from a specific direction in which radio waves should be transmitted to thus reduce noise, which leads to an improvement in quality of transmission and a reduction of energy consumption.

Also, th 5G communication may, instead of transmitting transmission signals modulated through Orthogonal Frequency Division Multiplexing (OFDM), transmit radio signals modulated through Non-Orthogonal Multiplexing Access (NOMA), thereby allowing multi-access of more devices while enabling massive transmission/reception.

For example, 5G communication can provide transmission speed of maximally 1 Gbps. Accordingly, 5G communication can support immersive communication requiring massive transmission to transmit/receive massive data, such as Ultra High Definition (UHD), 3D, and holograms. Thus, a user can use 5G communication to transmit/receive more delicate, immersive ultra-high capacity data at high speed. 5G communication may allow real-time processing having maximum response speed of 1 ms or less. Accordingly, 5G communication can support real-time services responding to inputs before a user recognizes them.

For example, if a communication module of enabling 5G communication is installed in a vehicle, the vehicle itself can act as a communication agent of transmitting and receiving data. Accordingly, the vehicle, which can communicate with external devices, may receive, even when it runs, sensor information from various devices, perform real-time processing on the sensor information to provide an autonomous driving system while providing various remote control.

Also, as shown in FIG. 2, a vehicle 10 may use 5G communication to process sensor information related to other vehicles 20, 30, and 40 existing around the vehicle 10 in real time to thereby provide a user with information on collision probability in real time while providing information on traffic situations of a driving path on which the vehicle runs in real time.

Also, through ultra real-time processing and massive transmission that are provided by 5G communication, the vehicle 10 can provide a big data service to passengers in the vehicle 10. For example, the vehicle 10 may analyze various web information or Social Network Service (SNS) information to provide customized information suitable for the situations of passengers in the vehicle 10. According to an embodiment, the vehicle 10 may perform big data mining to collect information on famous restaurants or popular attractions around a driving path on which the vehicle 10 runs to provide the collected information in real time, thereby enabling passengers to acquire various information about a region in which the vehicle runs.

Meanwhile, a 5G communication network can subdivide cells to support network densification and massive transmission. Herein, a cell means an area subdivided from a wide region in order to efficiently use frequencies for mobile communication. A low-power base station may be installed in each cell to support communication between terminals. For example, the 5G communication network may reduce the sizes of cells to further subdivide the cells so as to be configured as a 2-stage structure of macrocell base station-distributed small base station-communication terminal.

Also, in the 5G communication network, relay transmission of radio signals through multi-hop may be performed. For example, a vehicle located in a network of a base station BS may relay a radio signal transmitted from another vehicle or a device located outside the network of the base station BS, to the base station BS. Accordingly, a region in which the 5G communication network is supported can be widened, and also, buffering occurring when there are too many users in a cell may be reduced.

5G communication can support Device-to-Device (D2D) communication that is applied to vehicles, communication devices, and so on. D2D communication enables a device to directly transmit/receive radio signals to/from another device not via a base station. According to D2D communication, a device does not need to transmit/receive radio signals via a base station, and since radio signals are transmitted directly between devices, unnecessary energy consumption can be reduced.

Hereinafter, an antenna structure for enabling a vehicle to perform 5G communication will be described.

Figure 3:
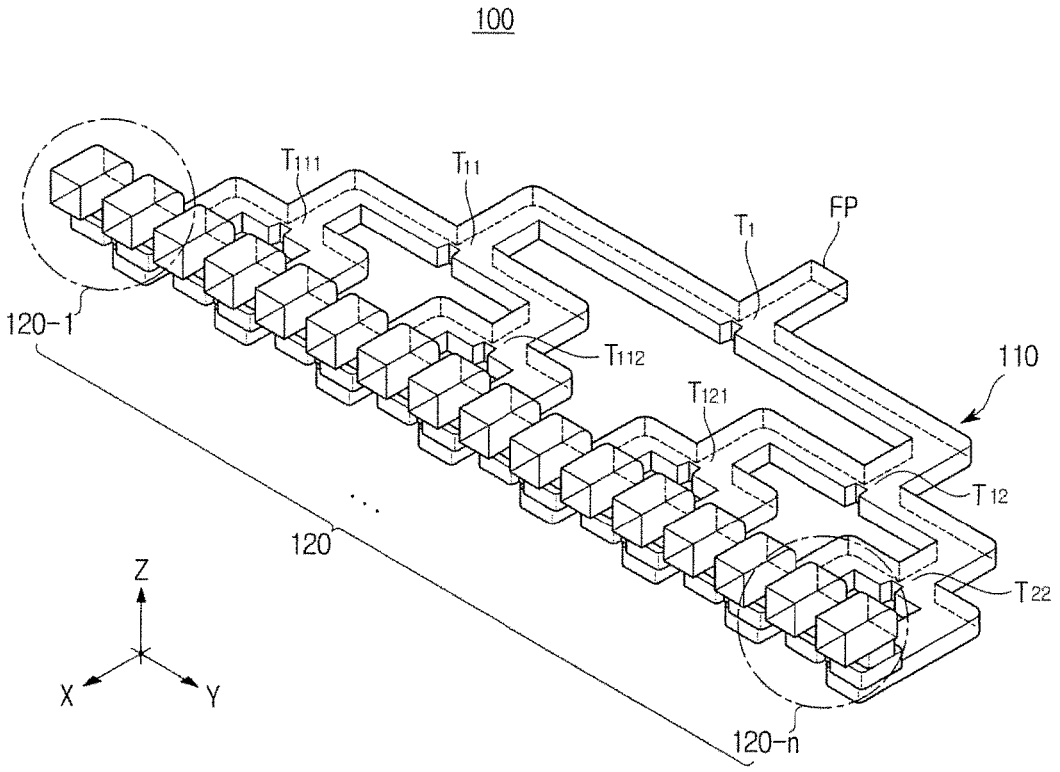
FIG. 3 is a perspective view showing a structure of an antenna according to an embodiment in the present disclosure.

FIG. 3 is a perspective view showing a structure of an antenna according to an embodiment in the present disclosure.

As shown in FIG. 3, an antenna 100 according to an embodiment in the present disclosure may include a radiation unit 120 (that is, a plurality of radiation units 120-1 to **120-*n*) to radiate radio signals to the outside, and a feed circuit 110 to transfer radio signals from a feed point FP to the radiation units 120-1 to 120-*n***.

The feed circuit 110 may be a parallel type feed in which a waveguide diverges into several branches to transmit and receive wideband radio signals. The feed circuit 110 may have a T-junction structure or a tournament structure in which each branch is divided into several parts at a diverging point, as shown in FIG. 3.

More specifically, a waveguide extending in an X-axis direction from the feed point FP may diverge into two waveguides at a 1st diverging point $T_1$, and the two waveguides may each diverge into two waveguides at an 11th diverging point $T_{11}$ and at a 12th diverging point $T_{12}$.

The two waveguides diverging at the 11th diverging point $T_{11}$ may each again diverge into two waveguides at a 111st diverging point $T_{111}$ and at a 122nd diverging point $T_{122}$.

In FIG. 3, an example in which a waveguide diverges in three stages is shown; however, this structure is only an example of a waveguide that can be applied to the antenna 100. That is, the waveguide may diverge in greater or fewer stages depending on how many radiation units are required.

In the structure described above, distances from the feed point FP to the plurality of radiation units 120-1 to **120-*n* may be the same. For example, a path extending from the feed point FP to the first radiation unit 120-1 via the 1st diverging point $T_i$, the 11th diverging point $T_{11}$, and the 111th diverging point $T_{111}$ may have the same length as a path extending from the feed point FP to the n-th radiation unit 120-*n*** via the 1st diverging point $T_1$, the 12th diverging point $T_{12}$, and the 122nd diverging point $T_{122}$.

Accordingly, signals transferred through the two paths may have the same phase and the same amplitude over the entire frequency region.

When power is supplied through a parallel type feed circuit structure, about 20% of the entire frequency region can be used. Accordingly, the parallel type feed circuit structure shows more excellent wideband characteristics than that of a serial type feed circuit structure capable of using about 3% of the entire frequency region.

The ends of the individual waveguides diverging in several stages may be connected to the respective radiation units 120-1 to **120-*n*. Since each waveguide is connected to one of the radiation units 120-1 to 120-*n*, the antenna 100 may include, when the feed circuit 110 diverges into n waveguides, n radiation units 120-1 to 120-*n***.

Figure 4:
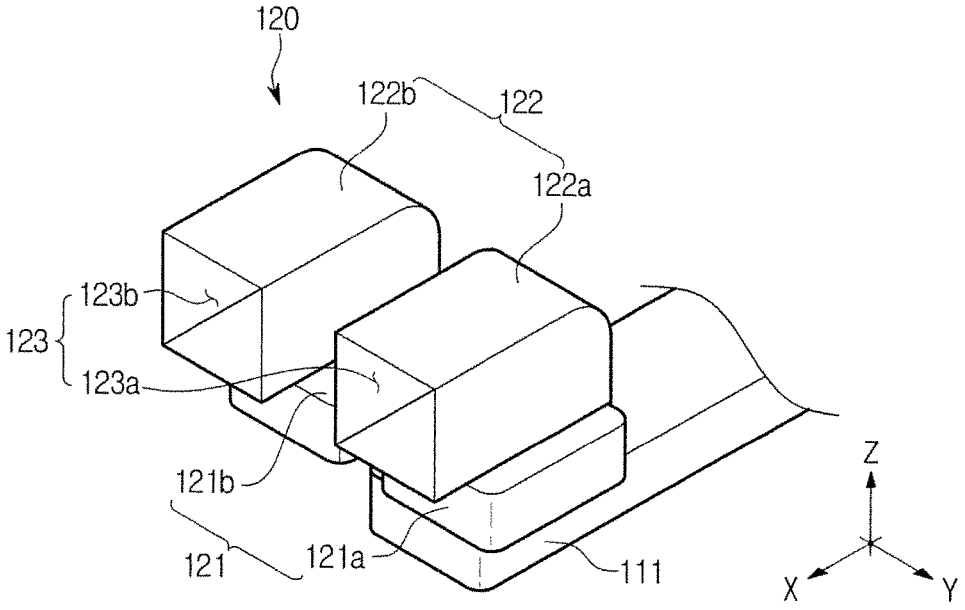
FIG. 4 is a perspective view showing a structure of a radiation unit connected to one end of a waveguide.
Figure 5:
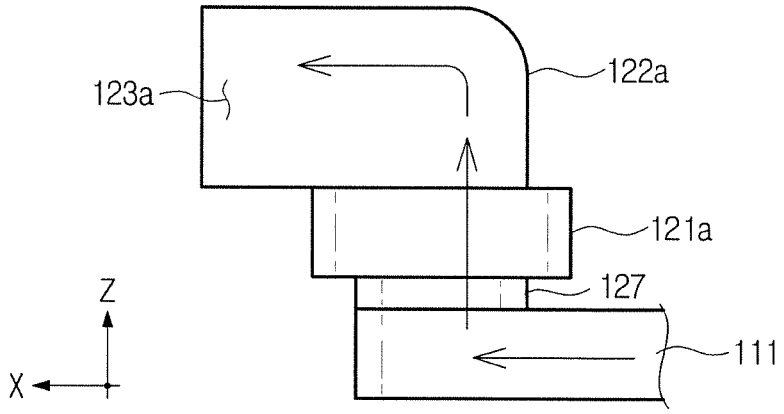
FIG. 5 is a plan view of a radiation unit connected to one end of a waveguide, as seen from above.
Figure 6:
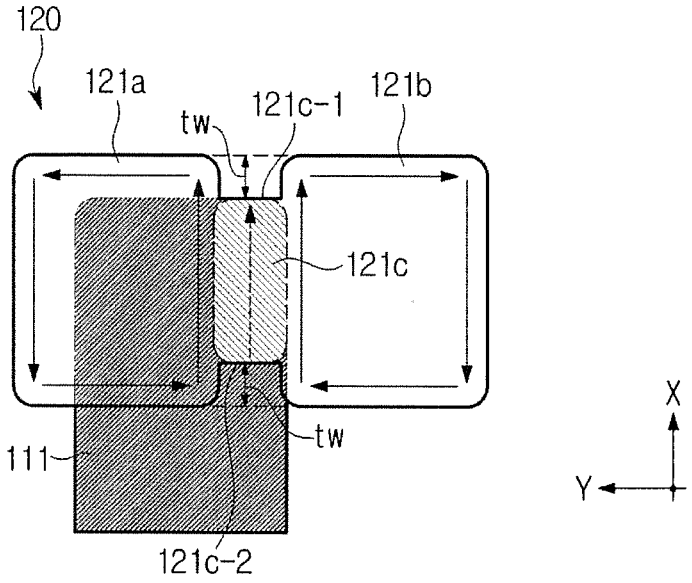
FIG. 6 is a side view of the radiation unit connected to one end of the waveguide, as seen from side.

FIG. 4 is a perspective view showing a structure of a radiation unit connected to one end of a waveguide, FIG. 5 is a plan view of a radiation unit connected to one end of a waveguide, as seen from above, and FIG. 6 is a side view of the radiation unit connected to one end of the waveguide, as seen from side. FIGS. 4, 5, and 6 show a structure of one of the plurality of radiation units 120-1 to **120-*n*, and the structure may be applied to all of the plurality of radiation units 120-1 to 120-*n***.

Referring to FIG. 4, a radiation unit 120 may be connected to a top of one end of a waveguide 111 to form a two-layer structure together with the feed circuit 110. That is, since the radiation unit 120 expands the antenna 100 in a Z-axis direction, instead of expanding the antenna 100 in an X- or Y-axis direction, the antenna 100 can improve design freedom.

The radiation unit 120 may include diverging cavities 121 (that is, a first diverging cavity **121*a*, a second diverging cavity 121*b*, and a diverging wall 121*c*) in which a radio signal received from the waveguide 111 diverges, and radiation cavities 122 (that is, a first radiation cavity 122*a* and a second radiation cavity 122*b*) to change the transmission direction of the radio signal diverging in the diverging cavities 121** so as to radiate the radio signal to the outside.

As shown in FIG. 5, a radio signal transmitted in the X-axis direction through the waveguide 111 may flow in the Z-axis direction toward the diverging cavities 121 through a coupling slot 127 at the end of the waveguide 111. The radio signal passed through the diverging cavities 121 may be radiated to free space through the radiation cavities 122, wherein the positions of radiation shots 123 (that is, **123*a* and 123*b*) formed in the radiation cavities 122** may be adjusted to change the transmission direction of the radio signal.

As shown in FIG. 6, the diverging cavities 121 may include the first diverging cavity **121*a* and the second diverging cavity 121*b* in order to divide a received radio signal into two signals having the same magnitude and phase. The diverging wall 121*c* for impedance matching may be positioned between the first diverging cavity 121*a* and the second diverging cavity 121*b*. A radio signal entered the diverging cavities 121 may be subject to impedance matching at the diverging wall 121*c*, and then flow to the first diverging cavity 121*a* and the second diverging cavity 121*b***.

Since a radio signal received through the waveguide 111 has millimeters waves according to 5G communication, it is difficult to perform impedance matching on the radio signal using a circuit device, such as an inductor L, a capacitor C, and the like. However, since the antenna 100 according to an embodiment in the present disclosure performs impedance matching using the structure of the diverging wall 121*c*, the antenna 100 can overcome difficulties in impedance matching using a circuit device.

The diverging wall 121*c* may be implemented as a wall protruding to the inside of the diverging cavities 121, and may include a first diverging wall 121*c*-1 and a second diverging wall 121*c*-2 formed up and down in the X-axis direction. The thickness $t_w$ of the diverging wall 121*c* may be determined based on the frequency of the radio signal.

The radio signal subject to impedance matching at the diverging wall 121*c* may diverge into two radio signals to flow into the first diverging cavity 121*a* and the second diverging cavity 121*b*, respectively, wherein the two radio signals may have the same phase and amplitude.

The first diverging cavity 121*a* and the second diverging cavity 121*b* have the same size. The size of the first diverging cavity 121*a* and the second diverging cavity 121*b* may be decided depending on the frequency of the radio signal such that the two radio signals diverging at the diverging wall 121*c* can travel around the first and second diverging cavities 121*a* and 121*b*, respectively.

On the diverging cavities 121, the radiation cavities 122 may be disposed to radiate the radio signals to the outside. More specifically, the first radiation cavity 122*a* may be disposed on the first diverging cavity 121*a*, and the second radiation cavity 122*b* may be disposed on the second diverging cavity 121*b*.

The radiation cavities 122 may include the radiation slots 123 (that is, 123*a* and 123*b*) to radiate the radio signals to free space. The radiation slots 123 may open to the outside.

The positions of the radiation slots 123 may be determined based on a direction in which radio signals should be radiated. For example, in order to radiate radio signals in the X-axis direction, the radiation slots 123 may be formed in the X-axis direction, as shown in FIGS. 4, 5, and 6.

The radio signals moved in the Z-axis direction from the end of the waveguide 111 via the diverging cavities 121 may be again transmitted in the X-axis direction through the radiation cavities 122. If the radiation cavities 122 are bent at right angles, the radio signals may be reflected, resulting in signal loss. For this reason, the radiation cavities 122 may be curved at the bent parts, as shown in FIG. 6, thereby minimizing loss due to reflection.

Since the radiation units 120 described above in FIGS. 4, 5, and 6 are respectively disposed at the ends of the n waveguides, the antenna 100 may have totally 2n×1 radiation slots 123. Accordingly, a radio signal having the same amplitude and phase as that of the radio signal provided from the feed point FP may be radiated to free space through each radiation slot 123.

Figure 7:
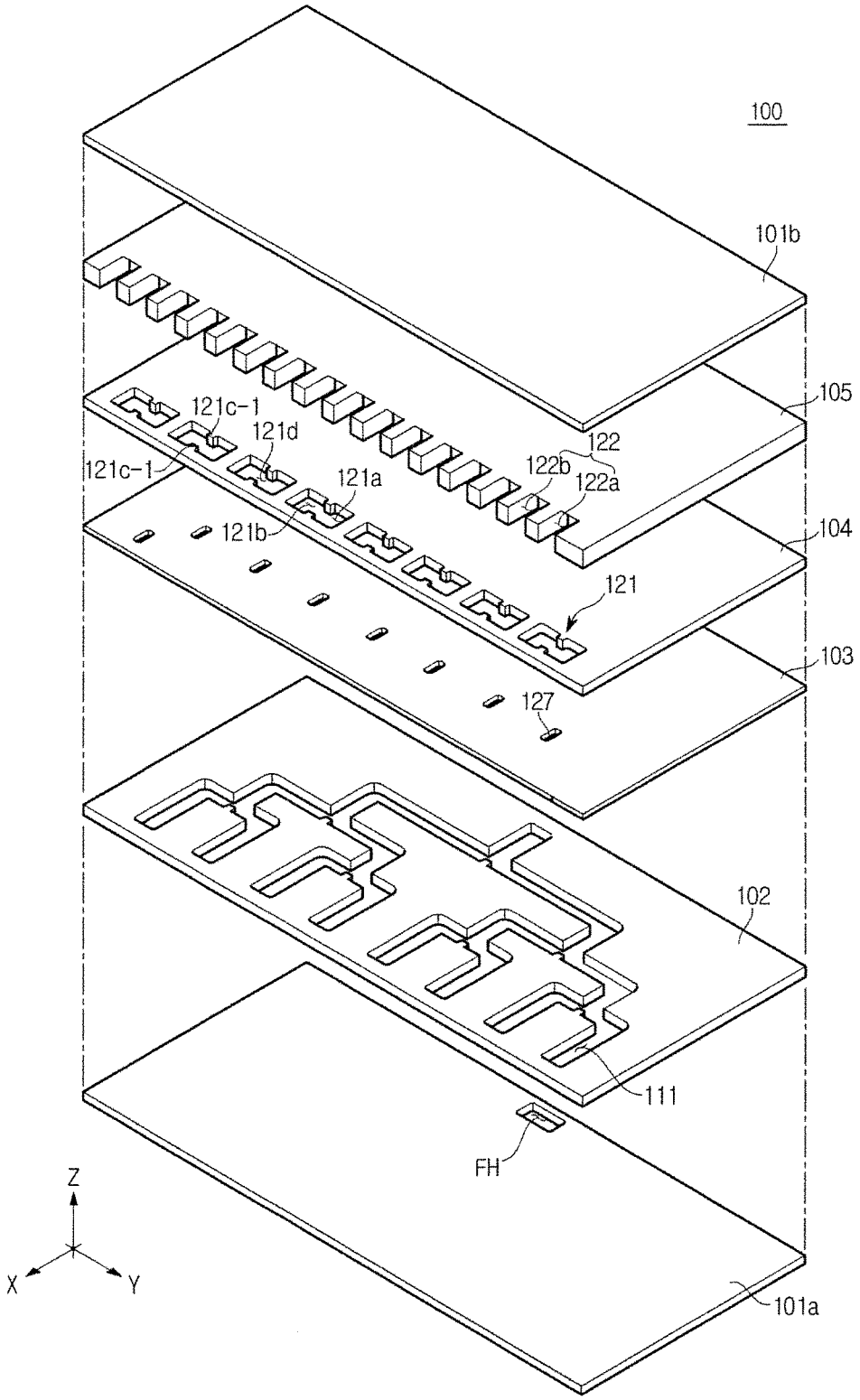
FIG. 7 is an exploded perspective view showing a structure of an antenna according to an embodiment in the present disclosure.

FIG. 7 is an exploded perspective view showing a structure of an antenna according to an embodiment in the present disclosure.

An antenna 100 according to an embodiment in the present disclosure may have a structure composed of only conductors, without using a dielectric substance or a circuit device, such as an inductor, a capacitor, or the like. All of the feed circuit 110, the diverging cavities 121, and the radiation cavities 122 may have cavity structures having a hollow space to transmit radio signals therethrough. That is, all of the feed circuit 110, the diverging cavities 121, and the radiation cavities 122 can transmit radio signals therethrough.

Referring to FIG. 7, an antenna 100 may include a lower plate 101*a* forming a bottom surface, and a upper plate 101*b* forming a top surface.

A feed plate 102 to form the feed circuit 110 may be disposed on the lower plate 101*a*. The feed circuit 110 may be formed in the feed plate 102 by removing a pattern corresponding to the feed circuit 110 from the feed plate 102. An area formed by removing the pattern corresponding to the feed circuit 110 from the feed plate 102 may become the waveguide 111 constituting the feed circuit 110.

At an area of the lower plate 101*a* corresponding to the feed point FP of the feed circuit 110, a feed hole FH may be formed to transfer a radio signal that is to be radiated to the outside to the feed circuit 110.

On the feed plate 102, a diverging plate 104 may be disposed in which the diverging cavities 121 are formed, and a coupling plate 103 for connecting the feed plate 102 to the diverging plate 104 may be disposed between the feed plate 102 and the diverging plate 104.

In the coupling plate 103, a plurality of coupling slots 127 may be formed to transfer a radio signal moved through the waveguide 111 to the diverging cavities 121. The coupling slots 127 may be arranged to correspond to one ends of the waveguide 111. Accordingly, if the waveguide 111 diverges into n parts, n coupling slots 127 may be formed in the coupling plate 103.

More specifically, the coupling slots 127 may be formed to correspond to the ends of the waveguide 111 and middle grooves 121*d* of the diverging cavities 121. The middle grooves 121*d* of the diverging cavities 121 refer to spaces between first diverging walls 121*c*-1 and second diverging walls 121*c*-2.

Radio signals entered the diverging cavities 121 through the coupling slots 127 may be subject to impedance matching when passing through the middle grooves 121*d* formed by the diverging walls 121*c*, and then be divided to enter the first diverging cavities 121*a* and the second diverging cavities 121*b*.

A radiation plate 105 may be stacked on the diverging plate 104. The first radiation cavities 122*a* and the second radiation cavities 122*b* may be formed in the radiation plate 105 in correspondence to the first diverging cavities 121*a* and the second diverging cavities 121*b* of the diverging plate 104.

The first radiation cavities 122*a* and the second radiation cavities 122*b* may open in an X-axis direction, and the upper plate 101*b* may be stacked on the radiation plate 105 so as to guide the radio signals entered the radiation cavities 122 in the X-axis direction and to emit the radio signals to the free space.

Figure 8:
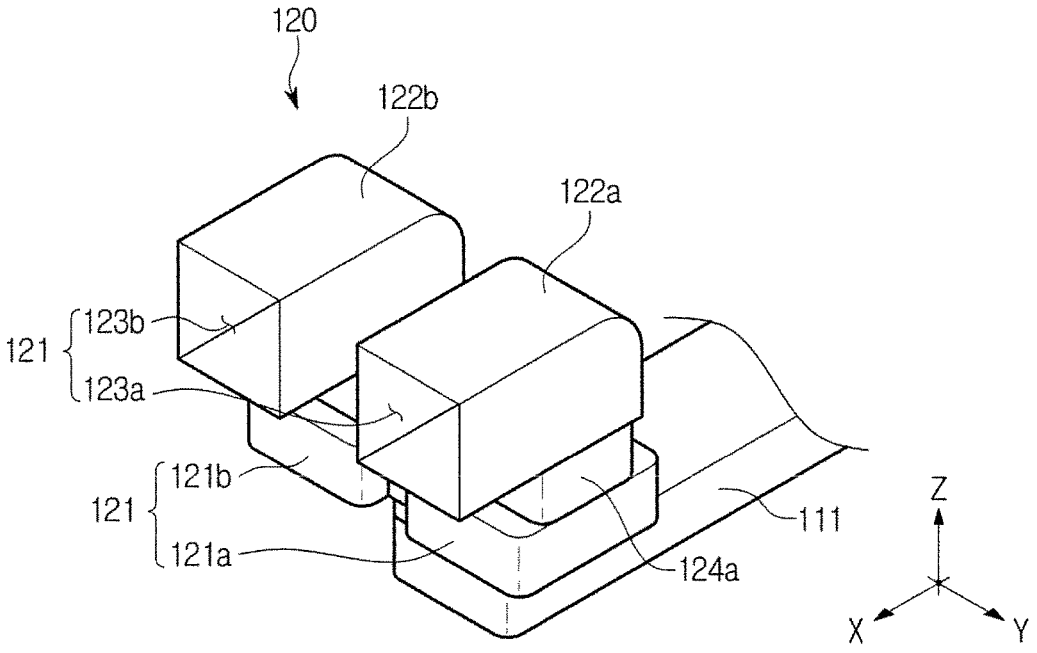
FIGS. 8 and 9 are perspective views of an antenna further including a harmonics blocking filter.
Figure 9:
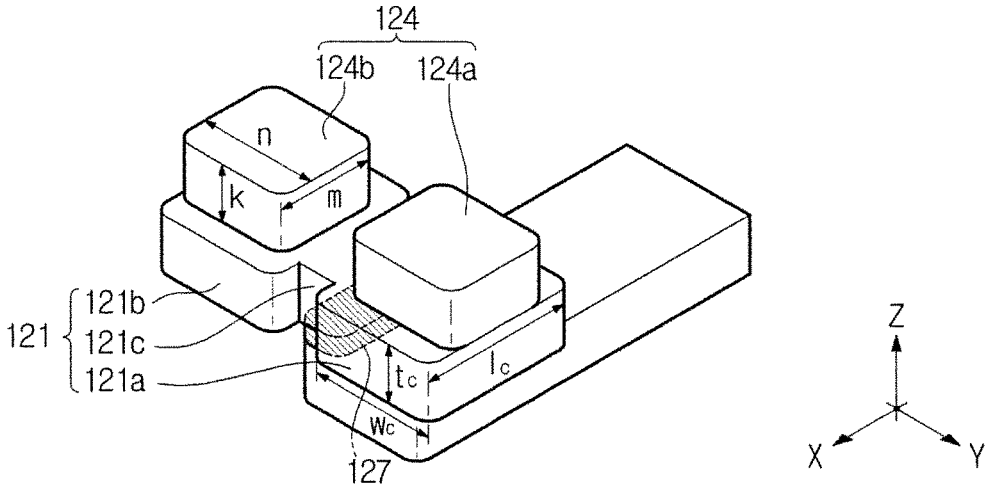
Figure 10:
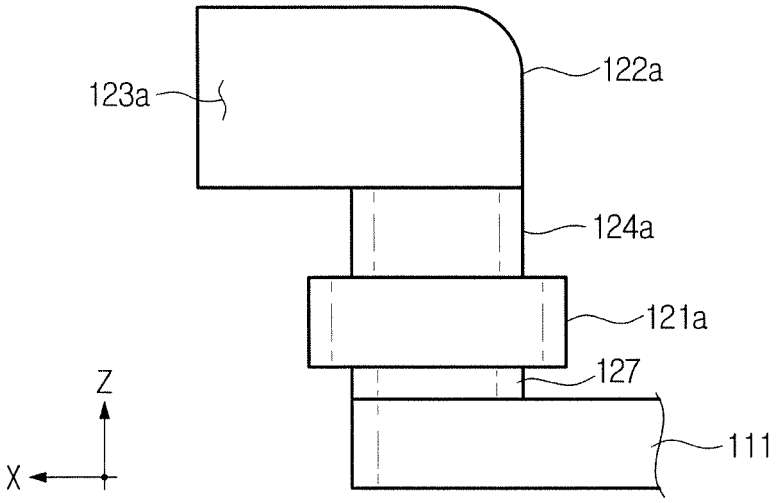
FIG. 10 is a side view of the antenna further including the harmonics blocking filter.

FIGS. 8 and 9 are perspective views of an antenna further including a harmonics blocking filter, and FIG. 10 is a side view of the antenna further including the harmonics blocking filter.

A radio signal passed through the diverging cavities 121 may include a harmonic component that is a m-times (where m is an integer that is equal to or greater than 2) the frequency component of a fundamental frequency. Since the harmonic component causes loss of radio signals, the antenna 100 may further include a harmonics blocking filter 124 disposed between the diverging cavities 121 and the radiation cavities 122, as shown in FIGS. 8 to 10, in order to remove such a harmonic component.

FIG. 9 shows the harmonics blocking filter 124 when the radiation cavities 122 are removed in order to show the harmonics blocking filter 124 in more detail.

Referring to FIG. 9, the harmonics blocking filter 124 may include a first blocking filter 124*a* formed on the first diverging cavity 121*a*, and a second blocking filter 124*b* formed on the second diverging cavity 121*b*. In the current embodiment, harmonic components may be removed using a physical, structural method, without using any circuit device for removing harmonic components.

The radio signals entered the first diverging cavity 121*a* and the second diverging cavity 121*b* may move to the first blocking filter 124*a* and the second blocking filter 124*b*, respectively, so that harmonics components may be removed from the radio signals, and the radio signals from which harmonic components have been removed may move to the radiation cavities 122 and then be emitted to the free space.

The sizes of the first blocking filter 124*a* and the second blocking filter 124*b* may be designed based on a loss rate of radio signals in the diverging cavities 121 and the sizes of the diverging cavities 121, according to Equation (1) and Equation (2), below.

$$E = E_0 \exp(-\alpha t_c), \text{ and} \tag{1}$$

$$\alpha = \sqrt{\left(\frac{m\pi}{l_c}\right)^2 + \left(\frac{n\pi}{w_c}\right)^2 - k^2}, \tag{2}$$

wherein E represents the energy of a radio signal before loss occurs, $E_o$ represents the energy of the radio signal after the loss occurs, $I_c$ represents the length of the first diverging cavity 121*a* and the second diverging cavity 121*b*, $t_c$ represents the height of the first diverging cavity 121*a* and the second diverging cavity 121*b*, $w_c$ represents the width of the first diverging cavity 121*a* and the second diverging cavity 121*b*, m represents the length of the first blocking filter 124*a* and the second blocking filter 124*b*, n represents the width of the first blocking filter 124*a* and the second blocking filter 124*b*, and *k* represents the height of the first blocking filter 124*a* and the second blocking filter 124*b*.

When the radio signals pass through the harmonics blocking filter 124, harmonic components may be removed from the radio signals, and the radio signals from which the harmonic components have been removed may enter the radiation cavities 122 and then be emitted to free space.

Figure 11:
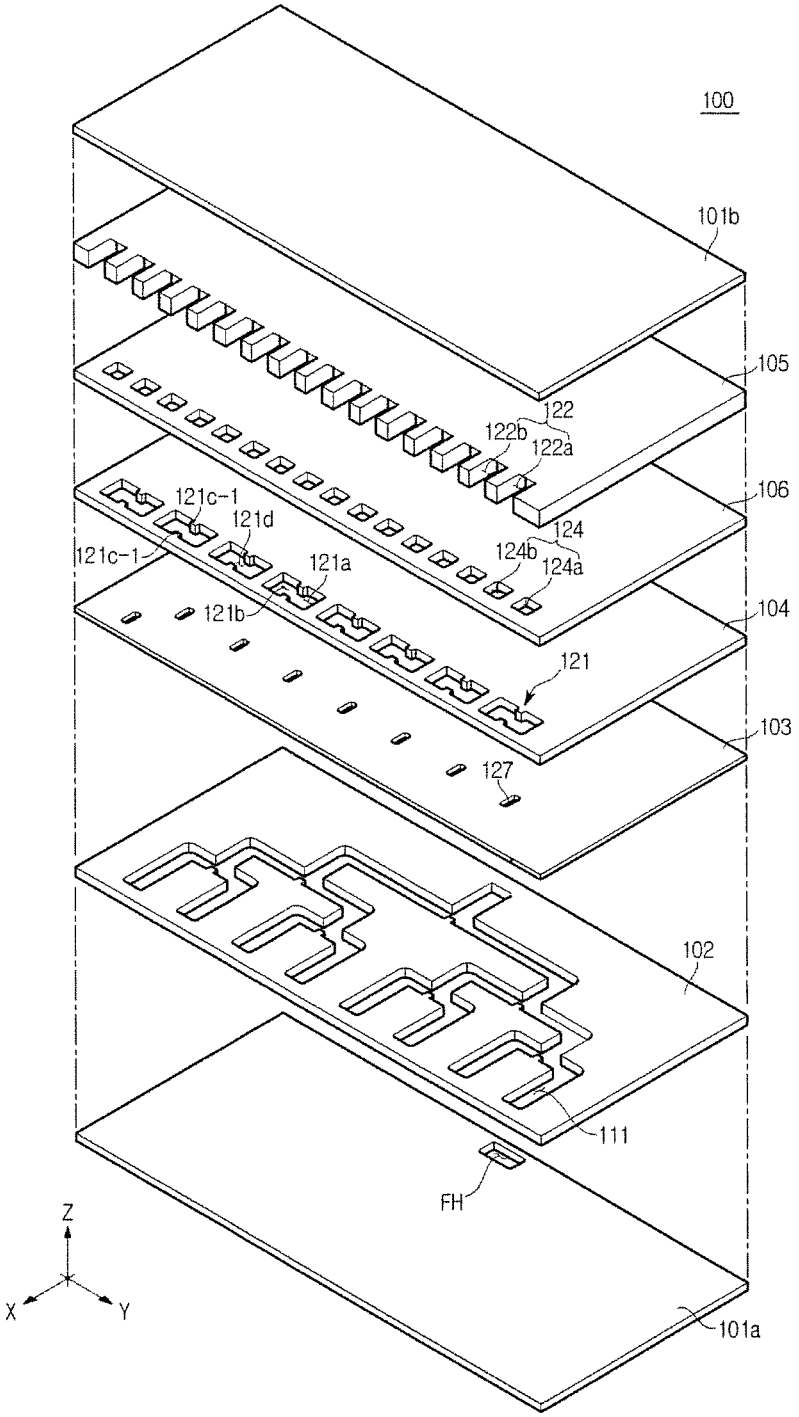
FIG. 11 is an exploded perspective view of the antenna further including the harmonics blocking filter.

FIG. 11 is an exploded perspective view of the antenna 100 further including the harmonics blocking filter 124.

Like the above-described structures, the harmonics blocking filter 124 may also have a cavity structure having a hollow space. As shown in FIG. 11, a filter plate 106 may be disposed between the diverging plate 104 and the radiation plate 105.

The harmonics blocking filter 124 may be formed in the filter plate 106 in correspondence to the diverging cavities 121 and the radiation cavities 122. More specifically, a plurality of first blocking filters 124*a* may be formed to correspond to the first diverging cavities 121*a* and the first radiation cavities 122*a*, and a plurality of second blocking filters 124*b* may be formed to correspond to the second diverging cavities 121*b* and the second radiation cavities 122*b*.

The lower and upper plates 101*a* and 101*b*, the feed plate 102, the coupling plate 103, the diverging plate 104, the filter plate 106, and the radiation plate 105 may be made of a conductor or a metal, such as copper, aluminum, lead, silver, stainless steel, or the like. However, the above-mentioned materials are only examples of materials that can be applied to the antenna 100, and the antenna 100 may be made of any other material as long as it can allow the flow of radio signals in cavities.

Figure 12:
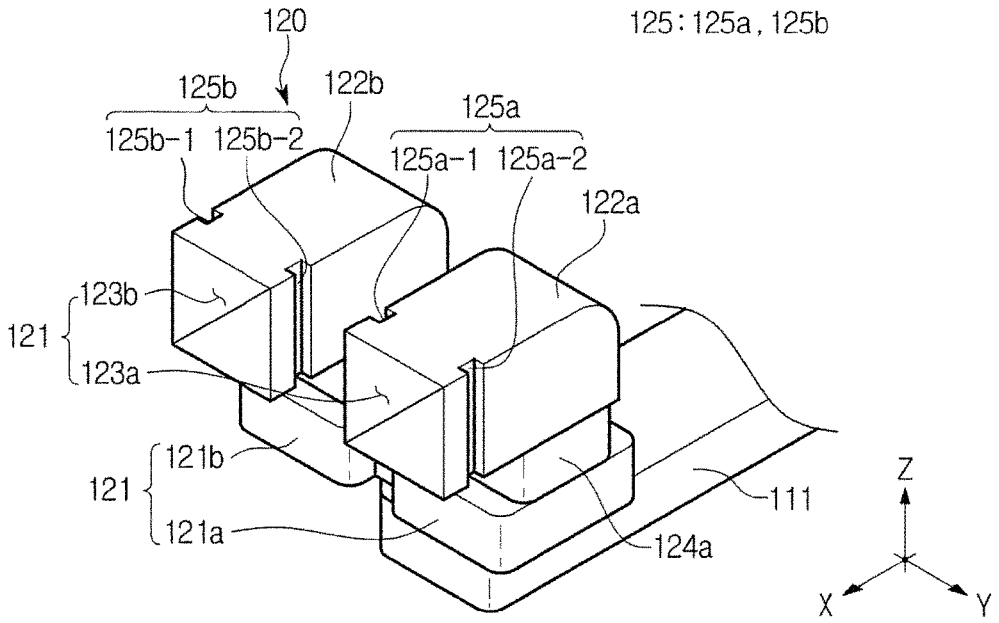
FIG. 12 is a perspective view of an antenna further including antireflection walls.
Figure 13:
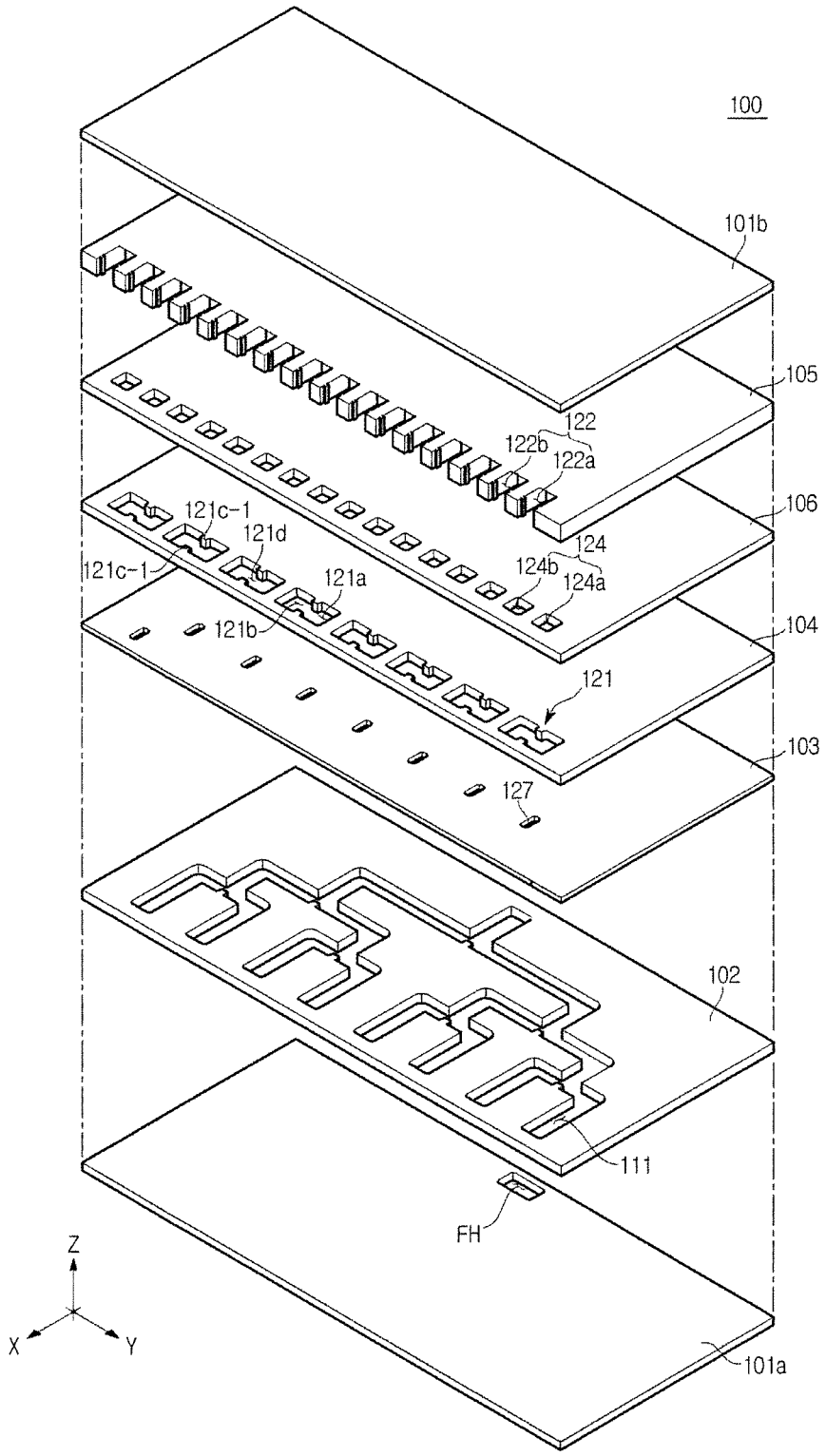
FIG. 13 is an exploded perspective view of the antenna further including the antireflection walls.

FIG. 12 is a perspective view of the antenna 100 further including antireflection walls, and FIG. 13 is an exploded perspective view of the antenna 100 further including the antireflection walls.

If radio signals are reflected in the radiation slots 123, a portion of radio signals that are emitted to free space may be reduced. Accordingly, the less reflection the radiation slots 123 cause, the more excellent performance the antenna 100 shows. For this reason, the antenna 100 may further include a plurality of antireflection walls 125 to reduce reflection in the radiation slots 123, as shown in FIG. 12.

For example, the antireflection walls 125 (that is, 125*a* and 125*b*) may be formed in the respective radiation cavities 122*a* and 122*b*. More specifically, each antireflection wall 125 may be in the form of a wall protruding toward the inside of the radiation cavity 122 along an axis that is vertical to the transmission direction of a radio signal.

For example, if the transmission direction of a radio signal is an X-axis direction, the antireflection walls 125 may protrude toward the inside of the radiation cavity 122 along a Y-axis. The antireflection walls 125 may be symmetrically formed at both sides of each radiation cavity 122. More specifically, the first radiation cavity 122*a* may include two first antireflection walls 125*a*-1 and 125*a*-2 protruding along the y-axis at both sides, and the second radiation cavity 122*b* may include two second antireflection walls 125*b*-1 and 125*b*-2 protruding along the Y-axis at both sides.

As shown in FIG. 13, by removing areas corresponding to the radiation cavities 122 from the radiation plate 105 except for areas corresponding to the antireflection walls 125, the shapes of walls protruding into the insides of the radiation cavities 122 may be formed.

The antireflection walls 125 may be formed adjacent to the radiation slots 123 to reduce reflection in the radiation slots 123. The location and thickness of the antireflection walls 125 may be determined based on the frequency of a radio signal.

The antenna 100 may receive radio signals from the outside, as well as transmitting radio signals. The above description may be also applied in the same way to the case in which the antenna 100 receives radio signals.

For example, radio signals input through the radiation slots 123 may change in transmission direction in the radiation cavities 122 (for example, X-axis direction→Y-axis direction), and then enter the diverging cavities 121 through the harmonics blocking filter 124. The radio signals respectively entering the first diverging cavity 121*a* and the second diverging cavity 121*b* may be summed to enter the end of the waveguide 111 through the coupling slot 127. The radio signal entering the end of the waveguide 111 may again change transmission direction (for example, Z-axis direction→X-axis direction), and then move to the feed point FP through the waveguide 111.

Figure 14:
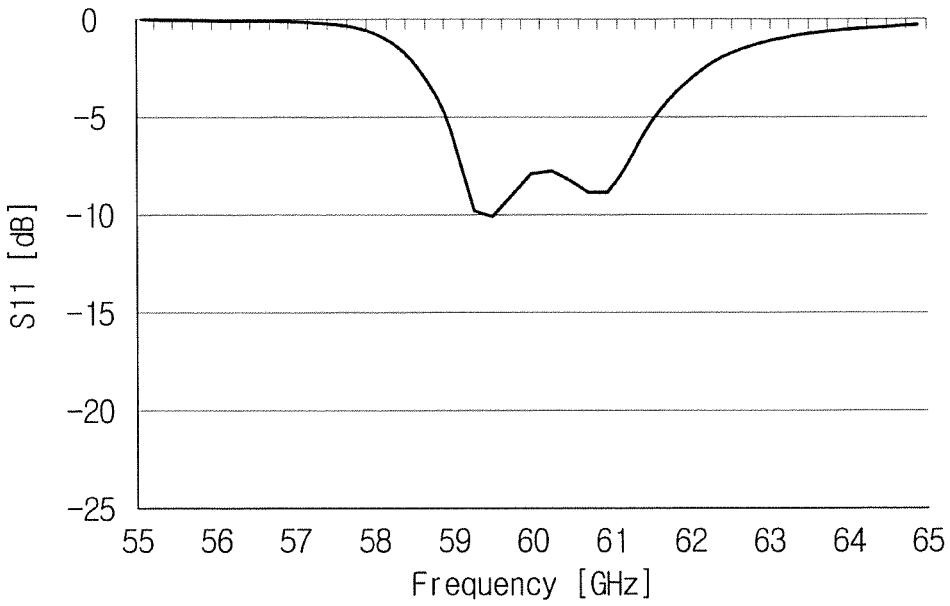
FIGS. 14 and 15 are graphs showing reflection characteristics of an antenna according to an embodiment in the present disclosure.
Figure 15:
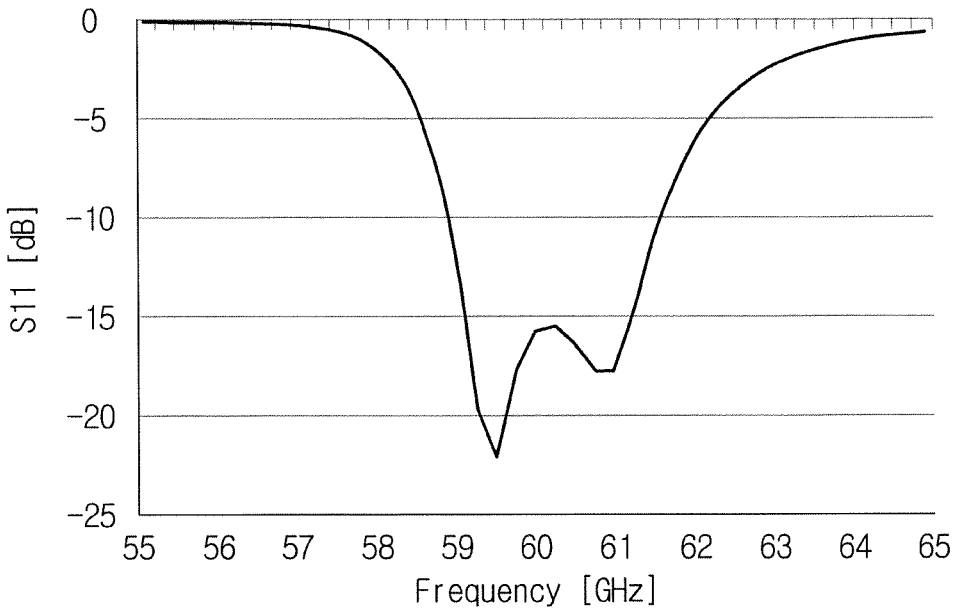

FIGS. 14 and 15 are graphs showing reflection characteristics of an antenna according to an embodiment in the present disclosure. FIGS. 14 and 15 show measurement results using an antenna designed for a frequency band of 60 GHz. As described above, an antenna may be configured with 2n×1 cells, wherein n is an integer that is equal to or greater than 2, and each cell may be configured with structures for guiding radio signals diverging in two directions.

In the current embodiment, an antenna 100 configured with 4×1 cells is used. That is, the antenna 100 includes two radiation units 120 arranged in the Y-axis direction. Also, the antenna 100 may be a subminiature antenna having a length of 8.4 mm in the X-axis direction and a length of 5.2 mm in the Z-axis direction, wherein the feed circuit 110 has a length of 4.4 mm in the X-axis direction and a length of 5.6 mm in the Y-axis direction.

Transmission and reception characteristics of a radio signal which is a Radio Frequency (RF) signal can be represented by an S parameter. The S parameter may be defined as a ratio of an output voltage to an input voltage on frequency distribution, and represented in scales of dB.

Since the antenna includes only input ports, an S11 parameter to represent a reflected value of a voltage may be used. The S11 parameter is also called a reflection coefficient.

The S11 parameter of the antenna 100 according to the embodiment shown in FIGS. 8, 9, and 10 may display characteristics as shown in FIG. 14. That the S11 parameter is sharply reduced at a specific frequency band means that reflection of an input voltage is minimized at the corresponding frequency band. In other words, resonance occurs in the corresponding frequency band so that reception or radiation of signals is optimized.

Also, the S11 parameter falling more deeply represents more excellent reflection characteristics of signals, and the graph of the S11 parameter falling over the greater width represents the wideband characteristics of the antenna 100.

Accordingly, it will be understood that the antenna 100 used for measuring the S11 parameter as shown in FIG. 14 displays excellent reflection characteristics in a frequency band of about 59 GHz to 61 GHz. The antenna 100 also displays wideband characteristics of 5% or more at −10 dB.

An S11 parameter of the antenna 100 according to the embodiment as shown in FIG. 12, that is, the antenna 100 in which the antireflection walls 125 are formed adjacent to the radiation slots 123, may display characteristics as shown in FIG. 15.

Comparing the S11 parameter of FIG. 15 to the S11 parameter of FIG. 14, it is shown that the S11 parameter of the antenna in which the antireflection walls 125 are formed falls more deeply than the S11 parameter of the antenna in which no antireflection walls are formed. That is, by forming the antireflection walls 125, the reflection characteristics of an antenna are improved by 5 dB or more.

Figure 16:
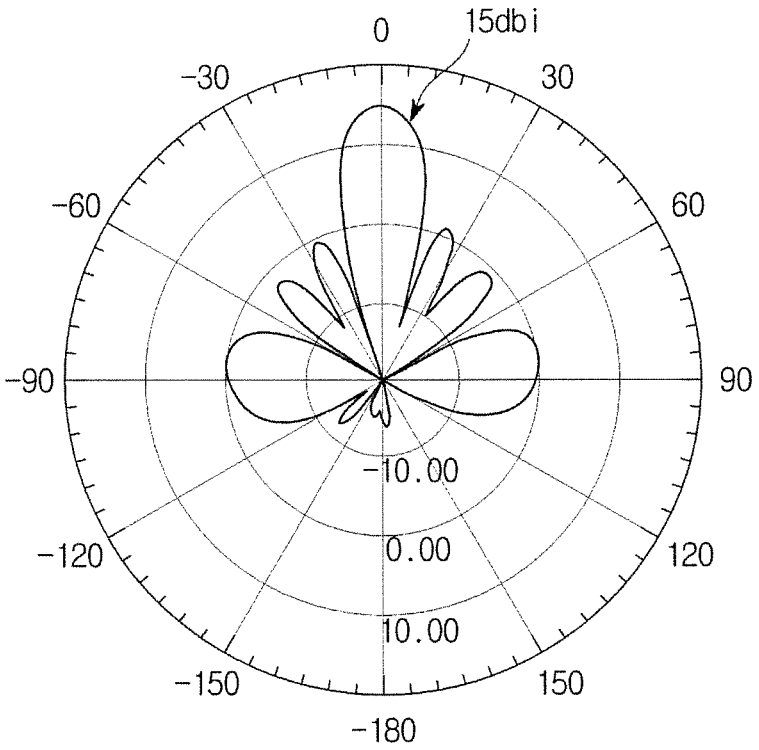
FIGS. 16 and 17 show radiation characteristics of an antenna according to an embodiment in the present disclosure.
Figure 17:
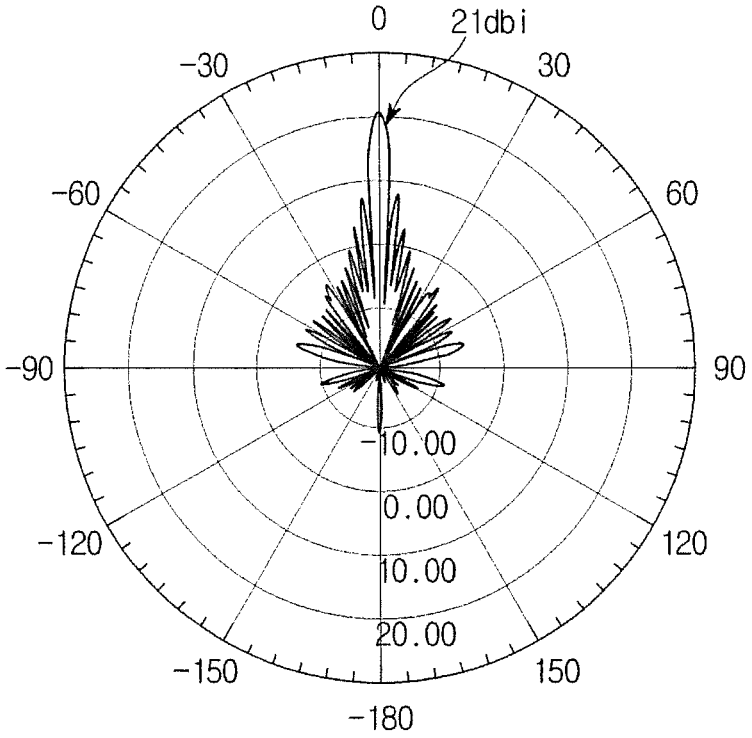

FIGS. 16 and 17 show the radiation characteristics of an antenna according to an embodiment in the present disclosure. FIG. 16 shows the radiation characteristics of an antenna 100 configured with 4×1 cells, measured on the xy plane, and FIG. 17 shows the radiation characteristics of an antenna 100 configured with 16×1 cells, measured on the xy plane.

Referring to FIG. 16, in the antenna 100 configured with 4×1 cells, a gain of 5 dBi or more can be obtained at the front.

Referring to FIG. 17, in the antenna 100 configured with 16×1 cells, a gain of 21 dBi or more can be obtained at the front, and the sharper beamwidth than that of the antenna 100 of FIG. 16 can be obtained while suppressing sidelobes.

Accordingly, a designer can adjust the number of the radiation units 120 as necessary to acquire a desired gain.

Since the antenna according to the above-described embodiment is composed of only conductors without using any medium having loss, such as a dielectric, high antenna efficiency of 70% or more can be obtained.

Also, by using a parallel feed circuit structure in which a waveguide diverges in stages, wideband characteristics can be obtained.

Also, by providing an array structure in which 2×1 radiation units are repetitively arranged, it is possible to easily acquire desired antenna characteristics by adjusting the number of radiation units that are arranged.

Also, by easily adjusting the locations of radiation slots, it is possible to radiate radio signals in a desired direction.

Hereinafter, an embodiment of a vehicle in which the antenna 100 according to the above-described embodiment is installed will be described.

Figure 18:
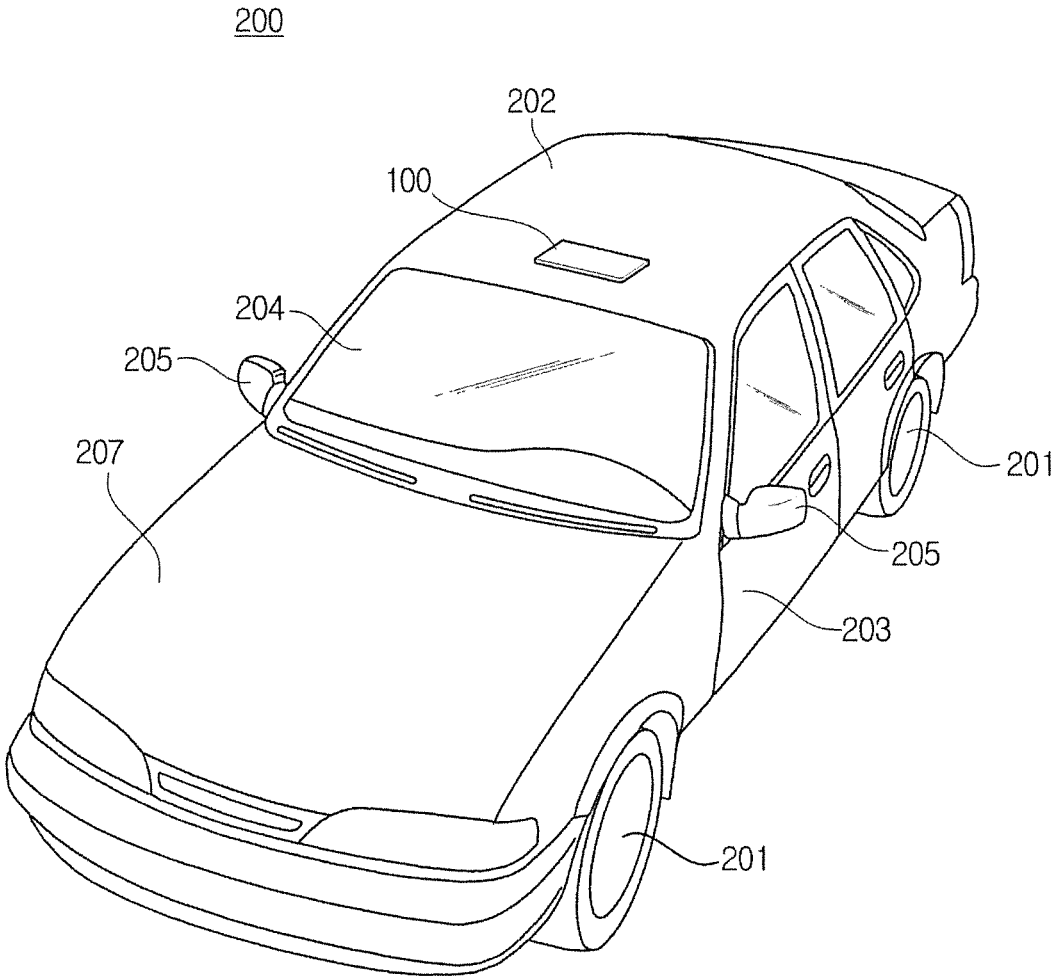
FIGS. 18 and 19 show outer appearances of a vehicle according to an embodiment in the present disclosure.
Figure 19:
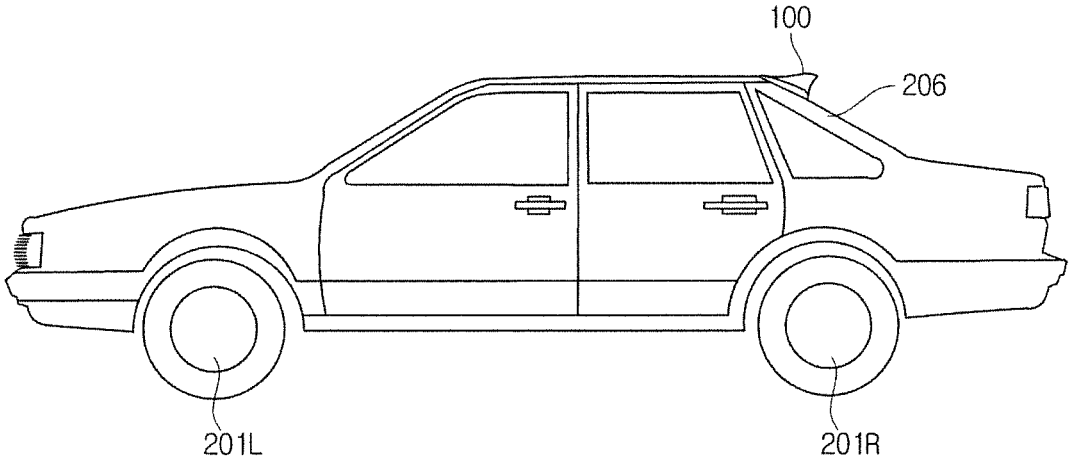

FIGS. 18 and 19 show outer appearances of a vehicle according to an embodiment in the present disclosure.

As shown in FIGS. 18 and 19, a vehicle 200 according to an embodiment in the present disclosure may include a plurality of wheels 201F and 201R to move the vehicle 200, a main body 202 forming an outer appearance of the vehicle 200, a driving apparatus (not shown) to rotate the wheels 201F and 201R, a plurality of doors 203 to shield the interior of the vehicle from the outside, a front glass 204 to provide a driver inside the vehicle 200 with front views of the vehicle 200, and a plurality of side-view mirrors 205L and 205R to provide the driver with rear views of the vehicle 200.

The wheels 201F and 201R may include front wheels 201F provided in the front part of the vehicle 200, and rear wheels 201R provided in the rear part of the vehicle 200. The driving apparatus, which is installed in the inside of an engine hood 207, may provide rotatory power to the front wheels 201F or the rear wheels 201R so that the vehicle 200 moves forward or backward.

The driving apparatus may adopt an engine to burn fossil fuel to produce rotatory power, or a motor to receive power from a condenser (not shown) to produce rotatory power.

The doors 203 may be rotatably provided to the left and right of the main body 202 to allow the driver to open one of them and get into the vehicle 200. Also, the doors 203 may shield the interior of the vehicle 200 from the outside when all of them close.

The front glass 204 may be provided in the upper, front part of the main body 202 to allow the driver inside the vehicle 200 to acquire a front view of the vehicle 200. The front glass 204 is also called a windshield glass.

The side-view mirrors 205L and 205R may include a left side-view mirror 205L provided to the left of the main body 202 and a right side-view mirror 205R provided to the right of the main body 202 to allow the driver inside the vehicle 200 to acquire side and rear views of the vehicle 200.

The antenna 100 may be installed on the outer surface of the vehicle 200. Since the antenna 100 is a subminiature antenna with a low-profile structure, the antenna 100 may be installed on a roof, as shown in FIG. 18, or on the engine hood 207. Also, the antenna 100 may be integrated into a shark antenna installed on the upper part of the rear glass 206, as shown in FIG. 19.

However, the location of the antenna 100 is not limited to the above-mentioned locations, and the antenna 100 may be installed at an appropriate location in consideration of a use of the antenna 100, a design of the vehicle 100, the linearity of radio waves, etc. The antenna 100 may have a low-profile structure with a very low height. Accordingly, the antenna 100 can be easily installed on the vehicle 200 at any location. Also, the number of the radiation units 100 constituting the antenna 100 or the locations of the radiation slots 123 can be easily adjusted to change the structure of the antenna 100 adaptively to the vehicle 200.

Figure 20:
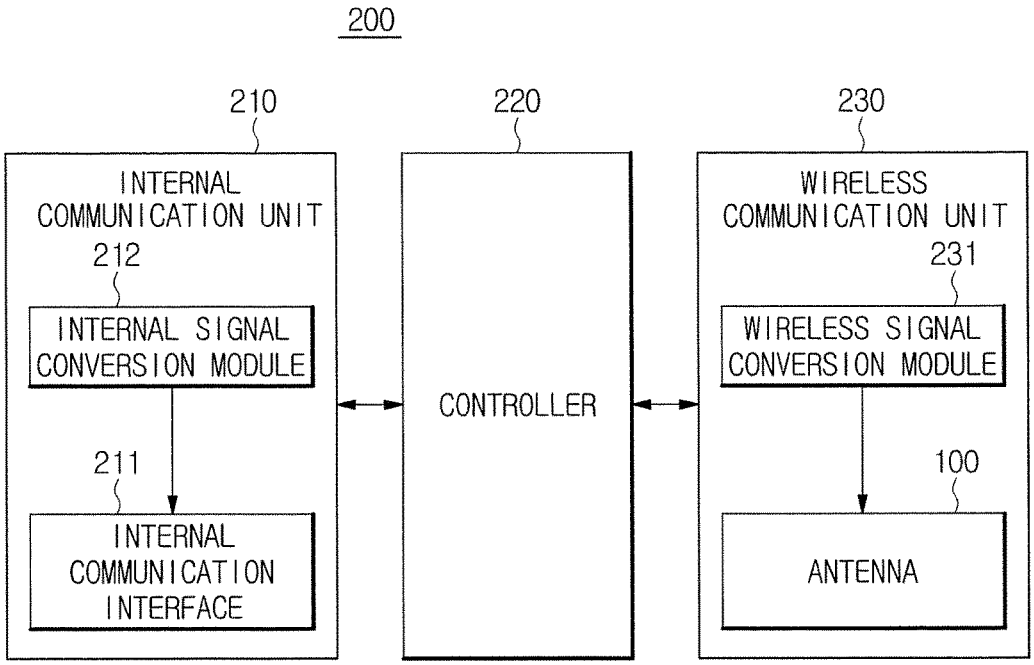
FIG. 20 is a control block diagram of a vehicle according to an embodiment in the present disclosure.
Figure 21:
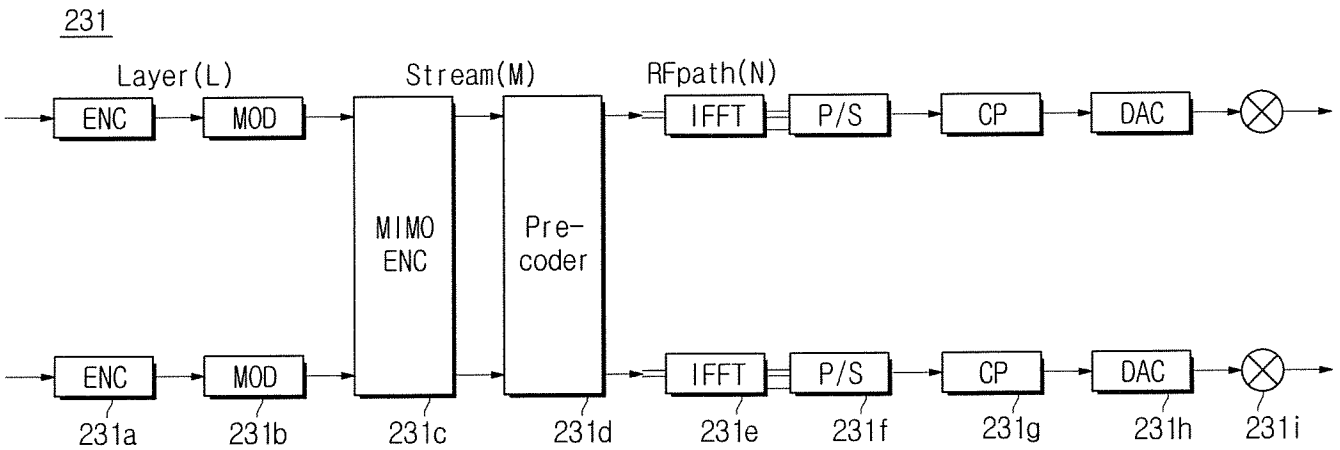
FIG. 21 is a block diagram showing configuration of a radio signal conversion module included in a communication unit.

FIG. 20 is a control block diagram of a vehicle according to an embodiment in the present disclosure, and FIG. 21 is a block diagram showing a configuration of a radio signal conversion module included in a communication unit.

Referring to FIG. 20, the vehicle 200 may include an internal communication unit 210 to communicate with various electronic devices in the vehicle 200 through a vehicle communication network, a wireless communication unit 230 to communicate with an external device, a base station, a server, or another vehicle, and a controller 220 to control the internal communication unit 210 and the wireless communication unit 230.

The internal communication unit 210 may include an internal communication interface 211 to connect to the vehicle communication network, and an internal signal conversion module 212 to modulate/demodulate signals.

The internal communication interface 211 may receive communication signals transmitted from various electronic devices in the vehicle 200 through the vehicle communication network, and transmit communication signals to the various electronic devices in the vehicle 200 through the vehicle communication network. Herein, the communication signals signify signals that are transmitted/received through the vehicle communication network.

The internal communication interface 211 may include a communication port and a transceiver to transmit/receive signals.

The internal signal conversion module 212 may demodulate a communication signal received through the internal communication interface 211 to a control signal according to the control of the controller 220 which will be described below, and modulate a control signal output from the controller 220 to an analog communication signal that is to be transmitted through the internal communication interface 211.

The internal signal conversion module 212 may modulate a control signal output from the controller 220 to a communication signal according to a communication standard of the vehicle communication network, and demodulate the communication signal according to the communication standard of the vehicle communication network to a control signal that can be recognized by the controller 220.

The internal signal conversion module 212 may include a memory to store data and programs for modulating/demodulating communication signals, and a processor to modulate/demodulate communication signals according to the data and programs stored in the memory.

The controller 220 may control operations of the internal signal conversion module 212 and the communication interface 211. For example, when a communication signal is transmitted, the controller 220 may determine whether the vehicle communication network was occupied by another electronic device through the internal communication interface 211, and control the internal communication interface 211 and the internal signal conversion module 212 to transmit the communication signal, if it is determined that the vehicle communication network is empty. Also, when a communication signal is received through the communication interface 211, the controller 220 may control the internal communication interface 211 and the signal conversion module 212 to demodulate the received communication signal.

The controller 220 may include a memory to store data and programs for controlling the internal signal conversion module 212 and the communication interface 211, and a processor to generate control signals according to the data and programs stored in the memory.

The wireless communication unit 230 may include a radio signal conversion module 231 to modulate/demodulate signals, and the antenna 100 to transmit the modulated signals outside or to receive signals from outside.

The radio signal conversion module 231 may demodulate a radio signal received by the antenna 100, and modulate a control signal output from the controller 220 to a radio signal that is to be transmitted to outside.

The radio signal may be included in carrier waves of a high frequency (for example, about 28 GHz in the 5G communication method) and transmitted. In order to include the radio signal in carrier waves of a high frequency, the radio signal conversion module 231 may modulate carrier waves of a high frequency (for example, about 28 GHz in the 5G communication method) to generate a radio signal, according to a control signal output from the controller 220, and demodulate a radio signal received by the antenna 100 to restore a signal.

For example, as shown in FIG. 21, the radio signal conversion module 231 may include an encoder (ENC) 231*a*, a modulator (MOD) 231*b*, a Multiple Input Multiple Output (MIMO) encoder 231*c*, a pre-coder 231*d*, an Inverse Fast Fourier Transformer (IFFT) 231*e*, a Parallel to Serial (P/S) converter 231*f*, a Cyclic Prefix (CP) inserter 231*g*, a Digital to Analog Converter (DAC) 231*h*, and a frequency converter 231*i*.

L control signals may pass through the encoder 231*a* and the modulator 231*b*, and then be input to the MIMO encoder 231*c*. Then, the MIMO encoder 231*c* may output M streams, and the M streams may be pre-coded by the pre-coder 231*d* to be converted into N pre-coded signals. The pre-coded signals may pass through the IFFT 231*e*, the P/S converter 231*f*, the CP inserter 231*g*, and the DAC 231*h*, and then be output as an analog signal. The analog signal output from the DAC 231*h* may be converted into a Radio Frequency (RF) band through the frequency converter 231*i*.

The radio signal conversion module 231 may include a memory to store data and programs for modulating/demodulating communication signals, and a processor to modulate/demodulate communication signals according to the data and programs stored in the memory.

However, the radio signal conversion module 231 is not limited to the configuration shown in FIG. 21, and may have any other configuration according to communication method.

The vehicle 200 may communicate with an external server or a control center through the antenna 100 to transmit/receive real-time traffic information, accident information, information on the state of the vehicle 200, etc. to/from the external server or the control center. Also, the vehicle 200 may transmit/receive sensor information measured by a sensor installed therein to/from another vehicle in order to communicate with the other vehicle, thereby adaptively coping with road conditions. Herein, the sensor installed in the vehicle 200 may include at least one of an imaging sensor, an accelerometer, an impact sensor, a gyro sensor, a proximity sensor, a steering angle sensor, and a speed sensor.

The antenna according to the embodiment in the present disclosure as described above has a low loss rate, high radiation directivity, and wideband characteristics in a millimeter wavelength region to be suitable for 5th-Generation (5G) communication, and also has a low-profile structure to reduce air resistance when installed in a vehicle.

Although embodiments have been described by specific examples and drawings, it will be understood to those of ordinary skill in the art that various adjustments and modifications are possible from the above description. For example, although the described techniques are performed in a different order, and/or the described system, architecture, device, or circuit component are coupled or combined in a different form or substituted/replaced with another component or equivalent, suitable results can be achieved.

Therefore, other implementations, other embodiments, and things equivalent to claims are within the scope of the claims to be described below.

What is claimed is:

1. An antenna installed in a vehicle, comprising:

a feed circuit through which a radio signal provided from a feed point is transmitted; and a plurality of radiation units, each radiation unit comprising a diverging wall configured to cause the radio signal transmitted through the feed circuit to diverge in at least two directions, and at least two diverging cavities through which radio signals diverged by the diverging wall are transmitted.

2. The antenna according to claim 1, wherein the feed circuit is disposed parallel to a ground on which the vehicle is placed, and the at least two diverging cavities are connected to a top end of the feed circuit.

3. The antenna according to claim 1, wherein the at least two diverging cavities have the same shape and the same size.

4. The antenna according to claim 1, wherein the diverging wall matches impedance of the radio signal.

5. The antenna according to claim 1, wherein the diverging wall is formed with at least one metal selected from among metals including copper, aluminum, lead, silver, and stainless steel.

6. The antenna according to claim 1, wherein the radiation unit further comprises at least two radiation cavities which are respectively disposed on the at least two diverging cavities, and in which at least two radiation slots for radiating the radio signals to the outside are formed.

7. The antenna according to claim 6, wherein the radiation cavities change a transmission direction of the radio signals.

8. The antenna according to claim 7, wherein the radiation cavities are curved at bent parts to change a transmission direction of the radio signals.

9. The antenna according to claim 6, wherein the radiation unit further comprises a harmonics blocking filter configured to remove a harmonic component of the radio signal.

10. The antenna according to claim 9, wherein the harmonics blocking filter comprises at least two harmonics blocking filters disposed between the at least two diverging cavities and the at least two radiation cavities.

11. The antenna according to claim 9, wherein the harmonics blocking filter has a size determined based on a size of each diverging cavity and energy of the radio signal.

12. The antenna according to claim 6, wherein in the radiation cavities, an antireflection wall protruding toward the inside of the radiation cavities, and configured to block reflection of the radio signals in the radiation slots is formed.

13. The antenna according to claim 12, wherein a location and a thickness of the antireflection wall are based a frequency of the radio signals.

14. The antenna according to claim 6, wherein the radiation slots open in a direction in which the radio signal is transmitted in the feed circuit.

15. The antenna according to claim 6, wherein the radio signal is transmitted upward toward the at least two diverging cavities from one end of the feed circuit, transmitted upward toward the radiation cavities from the at least two diverging cavities, and then changes a transmission direction in the radiation cavities so as to be transmitted toward the radiation slot.

16. The antenna according to claim 1, wherein the feed circuit diverges into a plurality of branches from at a feed point.

17. The antenna according to claim 16, wherein in the feed circuit, distances from the feed point to the plurality of radiation units are the same.

18. A vehicle comprising:

an antenna; and a controller configured to control the antenna, wherein the antenna comprising:

a feed circuit through which a radio signal provided from a feed point is transmitted; and a plurality of radiation units, each radiation unit comprising a diverging wall configured to cause the radio signal transmitted through the feed circuit to diverge in at least two directions, and at least two diverging cavities through which radio signals diverged by the diverging wall are transmitted.

19. The vehicle according to claim 18, wherein the feed circuit is disposed parallel to a ground on which the vehicle is placed, and the at least two diverging cavities are connected to a top end of the feed circuit.

20. The vehicle according to claim 18, wherein the radiation unit further comprises at least two radiation cavities which are respectively disposed on the at least two diverging cavities, and in which at least two radiation slots for radiating the radio signals to the outside are formed.

21. The vehicle according to claim 20, wherein the radiation cavities change a transmission direction of the radio signals.

22. The vehicle according to claim 20, wherein the radiation unit further comprises a harmonics blocking filter configured to remove a harmonic component of the radio signal.

23. The vehicle according to claim 22, wherein the harmonics blocking filter has a size that is decided depending on a size of each diverging cavity and energy of the radio signal.

24. The vehicle according to claim 20, wherein in the radiation cavities, an antireflection wall protruding toward the inside of the radiation cavities, and configured to block reflection of the radio signals in the radiation slots is formed.

* * * * *